US007048225B2

(12) United States Patent
Delfino

(10) Patent No.: US 7,048,225 B2
(45) Date of Patent: May 23, 2006

(54) NARROW PAPER TOWEL ROLL AND HOLDER

(76) Inventor: Nicholas A. Delfino, 2601 Nassau Bend, Suite 2C, Coconut Creek, FL (US) 33066

( * ) Notice: Subject to any disclaimer, the term of this patent is extended or adjusted under 35 U.S.C. 154(b) by 482 days.

(21) Appl. No.: 10/108,315

(22) Filed: Mar. 28, 2002

(65) Prior Publication Data

US 2003/0019975 A1 Jan. 30, 2003

Related U.S. Application Data

(60) Provisional application No. 60/307,972, filed on Jul. 25, 2001.

(51) Int. Cl.
*B65H 16/06* (2006.01)
*B65B 35/30* (2006.01)

(52) U.S. Cl. ..... 242/596.3; 53/443; 53/543; 206/229; 206/391

(58) Field of Classification Search ..... 242/596, 242/596.1, 596.4, 596.8, 596.3, 596.6, 160.1, 242/160.2, 160.3, 160.4; 53/154, 156, 443, 53/543; 206/389, 391, 410, 229
See application file for complete search history.

(56) References Cited

U.S. PATENT DOCUMENTS 2,222,951 A * 11/1940 Krueger
3,088,686 A * 5/1963 Curry
3,160,361 A * 12/1964 Monahan
3,593,361 A * 7/1971 Welt ..... 242/596.8
4,097,002 A 6/1978 Krueger
4,105,168 A 8/1978 Rutherford
D264,406 S 5/1982 Arnott
4,915,316 A 4/1990 Bastian
5,501,415 A * 3/1996 Harris et al. ..... 206/410
5,565,253 A * 10/1996 Crawford et al. ..... 206/389
5,662,288 A 9/1997 Chiang
5,727,750 A * 3/1998 Kelly ..... 242/596.3
5,833,170 A 11/1998 Molo
5,909,832 A * 6/1999 French et al. ..... 206/229
5,960,954 A * 10/1999 Seybold ..... 206/389

OTHER PUBLICATIONS www.waterindustry.org publication titled "P&G, Kimberly-Clark set for wet toilet paper wars", May 7, 2001.*

* cited by examiner

*Primary Examiner*—William A. Rivera
(74) *Attorney, Agent, or Firm*—Ronald V. Davidge

(57) ABSTRACT

A paper towel roll having a width of 12.7 to 15.24 centimeters (5 to 6 inches) is provided, along with a holder configured to hold the roll. The holder is composed of a plastic resin molded in a flattened condition and including a pair of arm portions that are folded outward to support the roll. A first version of the holder includes a pair of separate sections, with the arm portions extending toward one another and overlapping as the sections are brought together. A second version is molded as an integral structure, with the two arm portions extending in a common direction from a frame including an aperture in which one arm portion extends.

17 Claims, 1 Drawing Sheet

NARROW PAPER TOWEL ROLL AND HOLDER

This application claims benefit of a provisional application No. 60/307,972, filed Jul. 25, 2001.

BACKGROUND OF THE INVENTION

Field of the Invention

This invention relates to a narrow paper towel roll, having a width half that of a conventional paper towel roll, and, more particularly, to a method for supplying such a narrow paper towel roll with a suitable holder.

SUMMARY OF THE BACKGROUND ART

Conventional paper towels are supplied as a perforated paper web attached to and wrapped abound a tubular cardboard core. While such towels are widely available in a large number of variations, including differences in embossed and printed patterns and in the distance between the perforated lines facilitating the separation of the web into individual towels, the towels are invariably eleven inches wide. This width is often unnecessary for many uses to which the towels are placed, resulting in unnecessary costs, an unneeded use of resources, and requirements for space to be devoted to the transportation and storage of paper towels.

One impediment to providing a narrow paper towel roll, which could be stored and used more efficiently, arises from the fact that paper towel rolls are typically used within holders that are not suitable for narrow rolls. Thus, what is needed is a method for simultaneously providing both narrow paper towel rolls and a holder in which they can be used.

A conventional towel holder includes an elongated central portion and a pair of outward-extending arm portions, each of which includes a cylindrical support structure extending into an end of the tubular core in a towel roll extending between the arm portions. To hold the towel properly, the arm portions are typically made resilient, so that they can be pushed apart to allow the insertion therebetween of a paper towel roll, with the subsequent release of the arm portions, which then move toward one another with the cylindrical support structures extending into the ends of the tubular core within the roll.

For example, a conventional towel holder is molded as a single, integral part, in a "flattened" condition, with the arm portions being attached to the central portion by thin, flexible structures acting as hinges. In this flattened condition, the arm portions extend within separate apertures in the elongated central portion. When the arm portions are opened outward to provide for use of the holder with an installed paper towel roll, the stresses remaining in the flexible structures apply a biasing torque pivoting the arm portions toward one another, so that they are held in place with the cylindrical support structures extending into the ends of the tubular core within the roll. Other advantages of this construction are the simplification of the molding process to make a relatively thin part and the fact that, with the arm portions folded inward, the towel holder takes up a minimum volume during the processes of storage, transportation, and selling.

However, a holder for a narrow towel roll, having a width approximately half that of a conventional towel roll cannot be made in this way because the elongated central portion does not have sufficient width to accommodate the inward-directed arm portions in separate apertures. What is needed is a holder for a narrow towel roll incorporating most of the advantages of the molding in a flattened condition as an integral part.

U.S. Pat. Nos. 4,097,002 and 5,662,288 describe towel roll holders having separate arm portions that slide relative to one another before they are clamped in place on a surface to which the holder is mounted, providing a means for changing the width of the holder to accommodate differing widths of towel rolls. In the holder of U.S. Pat. No. 4,097,002, the arm portions are "L"-shaped members, one of which slides within the other, including flexible sections formed by notches in flanges so that the outward extending portions flex. However, these outward extending portions do not flex into apertures within the centrally extending portions, and cannot do so because of inadequate space within the centrally extending portions. In the holder of U.S. Pat. No. 5,662,288, each of the two arm portions includes an outward extending member connected by a hinge pin to a centrally extending member. The two centrally extending members are slidably mounted within a central elongated member.

U.S. Pat. No. 4,105,168 describes a towel roll holder having separate arm portions that slide relative to one another through a relatively short distance, with one of the arm portions being pulled within the other by an extension spring to hold the cylindrical support structures in engagement with the ends of the tubular core of a towel roll.

U.S. Pat. No. 5,833,170 describes a towel roll holder having an elongate base mountable to a support surface by driven fasteners and including opposed arm portion that are slidably engaged by brackets on a pair of opposed end supports. The end supports, in addition to the brackets and projecting stub shafts for the mounting of a roll of sheet material, include horizontal shelf surfaces that are maintained horizontally whether the base is mounted on a horizontal or vertical surface.

U.S. Pat. Nos. 4,915,316 and Des. 264,406 describe towel holders, each of which includes an elongated central member and a pair of end members attached to the central member by pivot pins.

What is needed is a holder for a narrow towel roll that can be molded in a flat condition and subsequently expanded into an open condition, so that the holder can be molded using a simple die, so that the holder can subsequently be packaged, transported, and sold in a configuration taking up a minimum space, and additionally so that a flexible section extending between the elongated central portion of the holder and at least one of the arm portions provides a biasing torque holding the cylindrical support structures of the holder in engagement within the ends of the tubular core of the towel roll.

SUMMARY OF THE INVENTION

According to a first aspect of the invention apparatus is provided for holding a paper towel roll. The apparatus includes a pair of end sections, each of which has an arm portion and a "U"-shaped frame portion having a closed end flexibly attached to said arm portion. Each of the arm portions is pivotable between a closed position, extending within said "U"-shaped frame portion having a closed end flexibly attached to said arm portion, and an open position, extending outward from said closed end of said "U"-shaped frame portion perpendicular to said "U"-shaped frame portion. Each of the arm portions includes a roll support plug extending toward an open end of said "U"-shaped frame portion with said arm portion in said open position. The open ends of said "U"-shaped frame portions are attachable to one another and separable from one another.

According to another aspect of the invention, apparatus is provided for holding a paper towel roll. The apparatus includes a frame portion, first and second arm portion, and a roll support plug extending from each arm portion. The frame portion extends around an aperture. The first arm portion is flexibly attached to a first end of said frame portion, and is pivotable between a closed position, extending within said aperture, and an open position, extending outward from said first end of said frame portion perpendicular to said frame portion. The second arm portion is flexibly attached to a second end of said frame portion, opposite said first end, and is pivotable between a closed position, extending away from said frame portion and parallel to said frame portion, and an open position, extending outward from said second end of said frame portion perpendicular to said frame portion. The roll support plug extends from each arm portion. The roll support plugs extend toward one another with said arm portions each in said open position.

According to yet another aspect of the invention, a package for retail sale is provided The package includes a paper towel roll and a holder. The paper towel roll has a tubular core and a paper web attached to said tubular core and wrapped around said tubular core. The holder has a pair of arm portions movable into positions extending along opposite ends of said paper towel roll, in which each said arm portion includes a roll support plug extending into an end of said tubular core as said arm portion extends along said end of said paper towel roll.

DETAILED DESCRIPTION OF THE INVENTION

Figure 1:
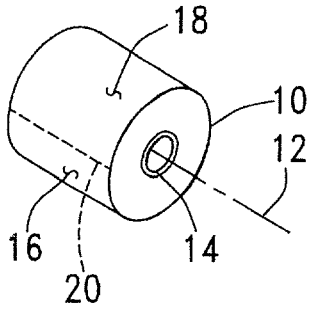
FIG. 1 is an isometric view of a narrow towel roll made in accordance with the invention.

FIG. 1 is an isometric view of a narrow paper towel roll 10, preferably having a width, along its axis 12 of approximately half the width of a conventional paper towel roll, which is 11 inches wide. For example, the width of the narrow paper towel roll 10 is between 5 and 6 inches. Other aspects of the narrow paper towel roll 10 may be conventional, with the paper towel roll being 5 to 6 inches in diameter, with a central core 14 having an inside diameter of about 1.625 inches, and with the towel material 16 being divided into sheets 18 about 9 inches long by perforations 20.

Figure 2:
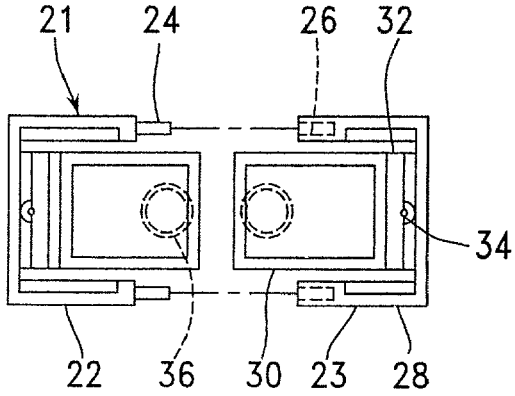
FIG. 2 is a front elevation of the two sections of a towel roll holder built in accordance with the present invention for holding the narrow towel roll of FIG. 1, shown in an exploded relationship.

FIG. 2 is a front elevation of a holder 21 configured for holding the roll 10 while allowing its rotation to dispense the towel material 16. The holder 21 is molded of a plastic resin, being formed in the flattened condition of FIG. 2 and in the form of a first section 22 and a second section 23. Before the holder 21 is installed on a wall or cabinet, these two sections 22, 23 are joined by sliding protrusions 24 extending from the first section 22 into mating sockets 26 within the second section 20. Each of these sections 22, 23 includes a frame portion 28 and an arm portion 30 which are joined by a thin flexible portion 32. Holes 34 are included for the placement of screws for attachment to a surface.

Figure 3:
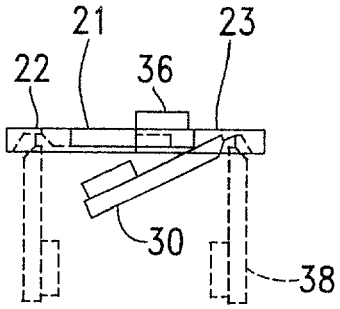
FIG. 3 is a plan view of the two sections of the towel roll holder of FIG. 2, shown as assembled together.

FIG. 3 is a plan view of the holder 21, with the two sections 22, 23 having been assembled. In this condition, the arms 30 overlap one another as shown by the solid lines. Each of the arm portions 30 includes a roll support plug 36 which is configured to fit within an end of the central core 14 of the narrow paper towel roll 10. After the holder 22 is attached to a surface, by means of screws extending within the holes 34, the arms 30 are pivoted into the extended positions shown by dashed lines 38. After the towel roll 10 is placed between the arms in these positions, the elasticity of the material within the flexible sections maintain axial forces applied to the ends of the towel roll 10. While rotation of the towel roll 10 on the roll support plugs 36 is allowed, free rotation is prevented, controlling the rate at which toweling is pulled off the roll 10.

Figure 4:
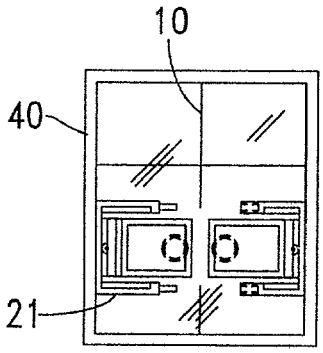
FIG. 4 is a front elevation of a package including six rolls together with the two sections of the towel roll holder of FIG. 1.

FIG. 4 is a front view of a package 40 for retail sale including six rolls 10 together with the holder 21. Preferably, mounting screws (not shown) are also included within the package 40. Initially, the products are preferably supplied in this way, allowing customers to obtain both the rolls 10 and the holder 21 at the same time. Then, the rolls 10 and the holders 21 would preferably be made available separately.

Figure 5:
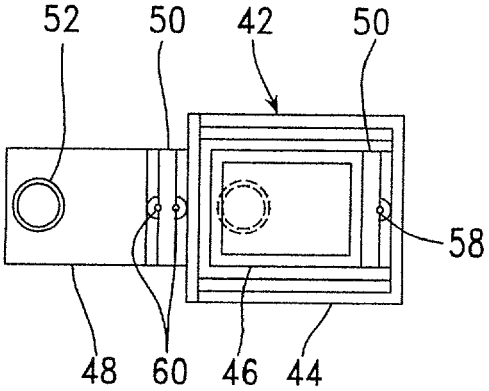
FIG. 5 is a front elevation of a towel roll holder built in accordance with an alternate embodiment of the present invention for holding the narrow towel roll of FIG. 1, shown in a flattened, as molded condition.

FIG. 5 is a front view of a holder 42 built in accordance with an alternative embodiment of the invention for holding the roll 10 while allowing its rotation to dispense the towel material 16. The holder 42 is molded of a plastic resin, being formed in the flattened condition shown in FIG. 5, including a frame portion 44, a first arm portion 46, and a second arm portion 48. Each of the arm portions 46, 48 is connected to the frame 44 by a flexible section 50.

Figure 6:
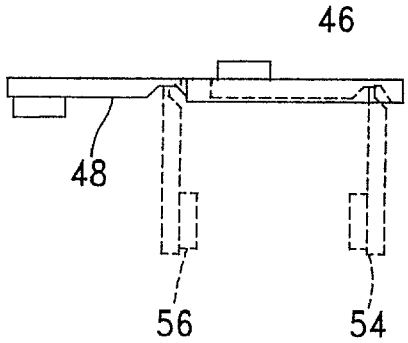
FIG. 6 is a plan view of the towel roll holder of FIG. 5.

FIG. 6 is a top view of the holder 42. Each of the arm portions 46, 48 includes a roll support plug 52 that is moved into position to hold an end of the central core 14 of the narrow paper towel roll 10 as the arm portions 46, 48 are pivoted into the positions indicated by dashed lines 54, 56 during a process of attaching the holder 42 to a mounting surface, such as a wall. Before the first arm portion 46 is pivoted into the position of dashed lines 54, a screw (not shown) is driven into the surface on which the holder 42 is being mounted through hole 58. When the second arm portion 48 is pivoted into the position of dashed lines 56, the holes 60 are aligned with one another, allowing a single screw to be driven to the surface on which the holder 42 is being mounted through both holes 60. This single screw assists in holding the holder 42 in place on this mounting surface and further holds the second arm portion 48 in the position of dashed lines 56. The elasticity of the flexible connection 50 between the frame portion 44 and the first arm portion 46 maintains the application of an axial force to the ends of the towel roll 10 placed on the holder 42.

While the invention has been described in its preferred forms or embodiments in some degree of particularity, it is understood that this description has been given only by way of example, and that numerous changes in the details of fabrication and use, including the combination and rearrangement of parts, may be made without departing from the spirit and scope of the invention.

What is claimed is:

1. Apparatus for holding a paper towel roll, comprising a pair of end sections, wherein each of said end sections includes an arm portion and a "U"-shaped frame portion having a closed end flexibly attached to said arm portion, each said arm portion is pivotable between a closed position, extending within said "U"-shaped frame portion having a closed end flexibly attached to said arm portion, and an open position, extending outward from said closed end of said "U"-shaped frame portion perpendicular to said "U"-shaped frame portion, each said arm portion includes a roll support plug extending toward an open end of said "U"-shaped frame portion with said arm portion in said open position, and open ends of said "U"-shaped frame portions are attachable to one another and separable from one another.

2. The apparatus of claim 1, wherein said open ends of said "U"-shaped frame portions include alignment features for aligning said "U"-shaped frame portions with one another.

3. The apparatus of claim 2, wherein said alignment features include a pair of pins and a pair of holes receiving said pair of pins as said open ends of said "U"-shaped frame portions are brought together.

4. The apparatus of claim 1, wherein said "U"-shaped frame member are attached to one another, and said arm portions overlap one another as said arm portions are each moved toward said closed position.

5. The apparatus of claim 1, wherein said "U"-shaped frame members are attached to one another, said arm portions, each in said open position, are separated by a separation distance of 12.7 to 15.24 centimeters (5 to 6 inches), and said roll support plugs extend into said separation distance.

6. The apparatus of claim 1, wherein each of said end sections is an integral structure composed of a plastic resin, and each said arm portions is attached to said "U"-shaped frame portion by a flexible section.

7. Apparatus for holding a paper towel roll, comprising:

a frame portion extending around an aperture;

a first arm portion flexibly attached to a first end of said frame portion, pivotable between a closed position, extending within said aperture, and an open position, extending outward from said first end of said frame portion perpendicular to said frame portion;

a second arm portion flexibly attached to a second end of said frame portion, opposite said first end, pivotable between a closed position, extending away from said frame portion and parallel to said frame portion, and an open position, extending outward from said second end of said frame portion perpendicular to said frame portion; and a roll support plug, extending from each arm portion, wherein said roll support plugs extend toward one another with said arm portions each in said open position.

8. The apparatus of claim 7, wherein said arm portions, each in said open position, are separated by a separation distance of 12.7 to 15.24 centimeters (5 to 6 inches), and said roll support plugs extend into said separation distance.

9. The apparatus of claim 7, wherein said apparatus is an integral structure composed of a plastic resin, and each said arm portions is attached to said frame portion by a flexible section.

10. The apparatus of claim 7, wherein said frame portion includes a first hole adjacent said second arm portion, said second arm portion includes a second hole adjacent said frame portion, said first and second holes are aligned with one another with said second arm portion in said open position, whereby a screw fastened to extend through said first and second holes holds said second arm in said open position.

11. A package for retail sale comprising:

a paper towel roll including a tubular core and a paper web attached to said tubular core and wrapped around said tubular core;

a holder including a pair of arm portions movable into positions extending along opposite ends of said paper towel roll, wherein each said arm portion includes a roll support plug extending into an end of said tubular core as said arm portion extends along said end of said paper towel roll, wherein said holder includes a pair of end sections each of said end sections includes an arm portion within said pair of arm portions and a "U"-shaped frame portion having a closed end flexibly attached to said arm portion, each said arm portion is pivotable between a closed position, extending within said "U"-shaped frame portion having a closed end flexibly attached to said arm portion, and an open position, extending outward from said closed end of said "U"-shaped frame portion perpendicular to said "U"-shaped frame portion, each said arm portion includes a roll support plug extending toward an open end of said "U"-shaped frame portion with said arm portion in said open position, and open ends of said "U"-shaped frame portions are attachable to one another and separable from one another.

12. The package of claim 11, wherein said open ends of said "U"-shaped frame portions include alignment features for aligning said "U"-shaped frame portions with one another.

13. The package of claim 12, wherein said alignment features include a pair of pins and a pair of holes receiving said pair of pins as said open ends of said "U"-shaped frame portions are brought together.

14. The package of claim 11, wherein said arm portions overlap one another as said arm portions are each moved toward said closed position with said open ends of said "U"-shaped frame members attached to one another.

15. The package of claim 14, wherein said holder includes a frame portion extending around an aperture;

a first arm portion flexibly attached to a first end of said frame portion, pivotable between a closed position, extending within said aperture, and an open position, extending outward from said first end of said frame portion perpendicular to said frame portion;

a second arm portion flexibly attached to a second end of said frame portion, opposite said first end, pivotable between a closed position, extending away from said frame portion and parallel to said frame portion, and an open position, extending outward from said second end of said frame portion perpendicular to said frame portion; and a roll support plug, extending from each arm portion, wherein said roll support plugs extend toward one another with said arm portions each in said open position.

16. The package of claim 15, wherein said holder is an integral structure composed of a plastic resin, and each said arm portions is attached to said frame portion by a flexible section.

17. The package of claim 15, wherein said frame portion includes a first hole adjacent said second arm portion, said second arm portion includes a second hole adjacent said frame portion, said first and second holes are aligned with one another with said second arm portion in said open position, whereby a screw fastened to extend through said first and second holes holds said second arm in said open position.

* * * * *